US005413255A

United States Patent [19]

Dent

[11] Patent Number: 5,413,255

[45] Date of Patent: May 9, 1995

[54] IMPROVEMENTS IN GAS POWERED APPLICATORS

[75] Inventor: Hugh Dent, Bradford on Avon, United Kingdom

[73] Assignee: Mark Anderson, Spring Valley, Wis.

[21] Appl. No.: 130,871

[22] Filed: Oct. 4, 1993

[51] Int. Cl.[6] ..... B67D 5/00

[52] U.S. Cl. ..... 222/309; 222/340; 222/387; 222/389

[58] Field of Search ..... 222/309, 334, 340, 387, 222/389

[56] References Cited

U.S. PATENT DOCUMENTS

| | | | |
|---|---|---|---|
| 2,845,066 | 7/1958 | Hoppe | 222/340 X |
| 3,254,806 | 6/1966 | Madsen | 222/389 X |
| 3,353,537 | 11/1967 | Knox et al. | 222/334 X |
| 3,813,012 | 5/1974 | Laird | 222/389 X |
| 3,838,793 | 10/1974 | Rochette | 222/389 X |
| 3,980,209 | 9/1976 | Collar | 222/389 X |
| 4,113,151 | 9/1978 | Brown et al. | 222/389 X |
| 4,426,024 | 1/1984 | Hogan et al. | 222/389 X |
| 4,467,943 | 8/1984 | Carse | 222/334 X |
| 4,826,050 | 5/1989 | Murphy et al. | 222/309 X |
| 5,015,233 | 5/1991 | McGough et al. | 222/389 X |
| 5,067,591 | 11/1991 | Fehlig | 222/389 X |

*Primary Examiner*—Andres Kashnikow
*Assistant Examiner*—Anthoula Pomrening
*Attorney, Agent, or Firm*—Charles E. Baxley

[57] ABSTRACT

A gas powered applicator for dispensing measured doses of a liquid comprising a handle with a detachable mounted dispensing unit and a manually operated gas control valve which selectively places the dispensing unit either in connection with a source of gas under pressure or in connection with an exhaust.

3 Claims, 2 Drawing Sheets

IMPROVEMENTS IN GAS POWERED APPLICATORS

1. Field of the Invention

This invention relates to gas powered applicators for dispensing measured doses of a liquid from a larger supply of such liquid. Such applicators are commonly used for veterinary purposes in dosing animals with liquid medicaments. However, it will be appreciated from the following description that the invention is not limited to such applications and may be used for many other purposes where it is necessary to dispense repeated measured doses of a liquid.

SUMMARY OF THE INVENTION

According to the invention, there is provided a gas powered applicator for dispensing measured doses of a liquid, comprising a handle, a dispensing unit mounted detachably on the handle and a manually operable gas control valve adapted, when operated, to place the dispensing unit selectively in communication with a source of gas under pressure or with exhaust, the dispensing unit comprising a cylinder, a piston slidable in gas and liquid-tight manner within the cylinder, with one end of the cylinder coupled to the control valve, and spring means biasing the piston towards the one end of the cylinder, and having an inlet for connection to a source of liquid to be dispensed and controlled by an inlet non-return valve, leading from the other end of the cylinder.

In operation, actuation of the gas control valve to place the dispensing unit into communication with the source of gas under pressure causes the piston to move away from the one end of the cylinder, against the action of the spring means, thereby expelling the contents of the cylinder through the outer means. Thereafter, operation of the gas control valve, places the dispensing unit into communication with the exhaust and allows the piston to be returned to the one end of the cylinder, under the action of the spring thereby drawing liquid to be dispensed into the other end of the cylinder through the inlet.

The outlet may comprise an outlet passage coaxial with the cylinder at said other end thereof. The outlet non-return valve may comprise a spring-loaded ball valve disposed in said outlet passage. The inlet may comprise a passage extending longitudinally through the piston. Preferably the inlet non-return valve is located in the passage, adjacent the end of the piston lying within the cylinder. The inlet non-return valve may comprise a spring-loaded ball valve disposed in the inlet passage. Coupling the one end of the cylinder to the gas control valve may comprise a readily detachable coupling and the dispensing unit may be readily detachable from the handle, so that it may be removed for repair or replacement. The spring may comprise a helical spring encircling a portion of the piston outside the cylinder and disposed between an abutment on the piston and cylinder respectively.

There is preferably mounted on the handle adjustment abutment means for limiting the extent of withdrawal of the piston from the cylinder, and thereby controlling the volume of the dose of liquid drawn into the cylinder and subsequently dispensed.

The abutment means may comprise an externally threaded elongate element slidably mounted on the handle, and threadedly engaged by an internally threaded operating element rotatably mounted on the handle, whereby rotation of the operating element effects longitudinal adjustment of the abutment element.

These and other objects and many of the attendant advantages of this invention will be appreciated readily as the same becomes better understood by reference to the following detailed description when considered in connection with accompanying drawings in which:

DESCRIPTION OF THE PREFERRED EMBODIMENT

Figure 1:
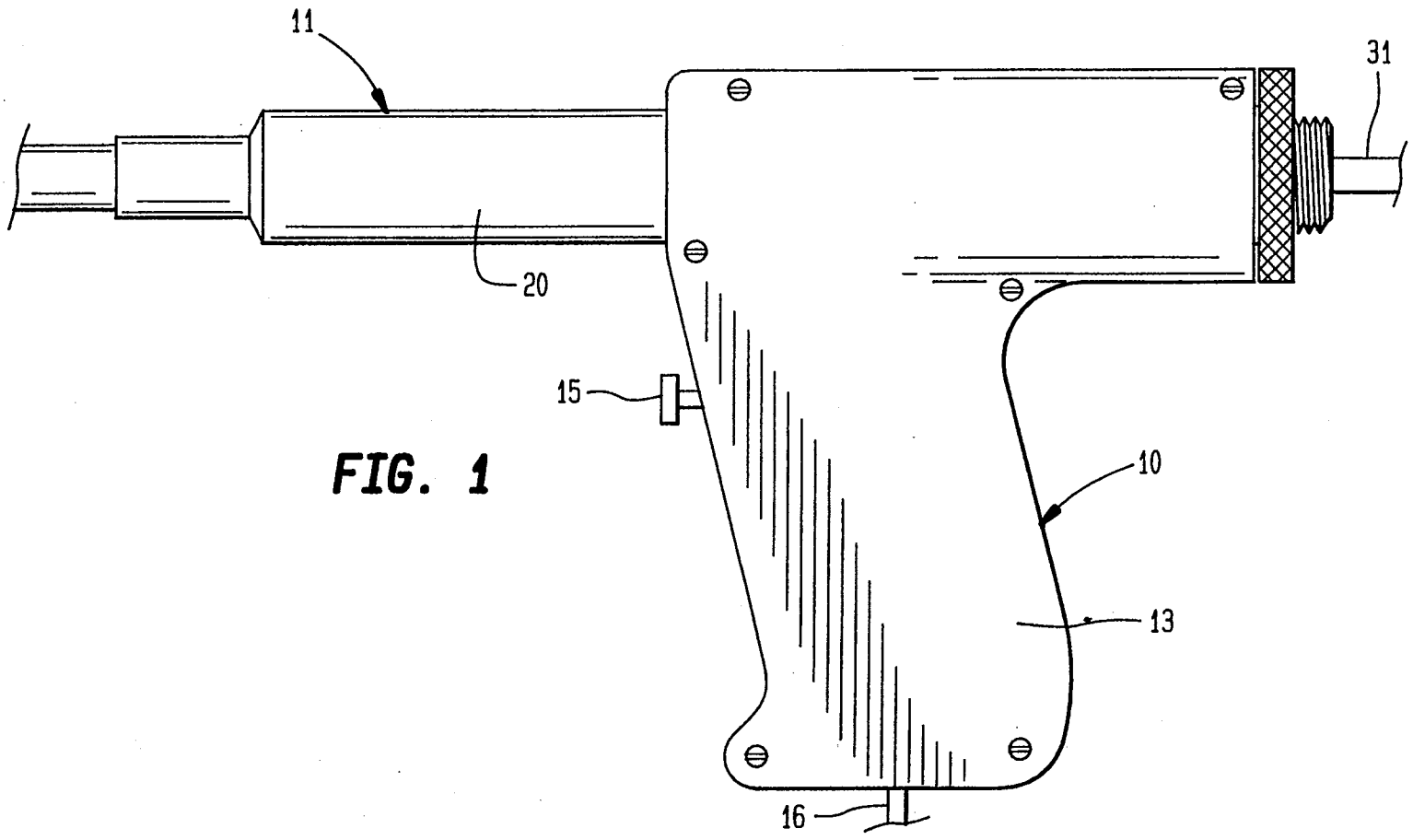
FIG. 1 is a side elevational view of a gas powered applicator in accordance with the invention.

Referring to the drawings, the applicator of the present invention is of generally pistol-like configuration comprising a handle generally designated 10 and a readily detachable dispensing unit generally designated 11. The handle 10, which may be molded from plastics material, comprises a hollow body part 12 (see FIG. 2) onto which is screwed a shaped cover plate 13 (see FIG. 1).

Mounted within the hollow part 12 of the handle is a gas control valve 14 controlled by an operating button 15. The valve communicates through an inlet pipe 16 with a source of gas under pressure (not shown). The source of gas may comprise a bottle of liquid carbon dioxide and a regulator that maintains a pressure of approximately 100 psi. Such gas bottles are commonly available and are provided with a safety valve and shut off tap. However, any other source of gas under pressure may be suitable, including, for example, an air pressure deliver line.

An exhaust port 17 leads from the control valve 14 to atmosphere and the valve has an outlet port 18 into which may be inserted a quick fit connector 19 on the dispensing unit 11. The control valve 14 normally closes off the pipe 16 leading from the source of gas under pressure and places the dispensing unit, through the port 18 and connector 19, into communication with the exhaust port 17. Upon depression of the actuating button 15 the dispensing unit 11 is cut off from communication with the exhaust port and is placed in communication with the source of gas under pressure through the line 16.

The dispensing unit 11 comprises a generally cylindrical barrel 20 which constitutes the cylinder of the unit. The barrel 20 is closed at one end by an end cap 21 which is in screw threaded engagement with a flanged collar 22, which encircles the end of the barrel 20, so as to clamp an end flange 23 on the barrel between the end cap 21 and the collar 22 and thus, hold the collar in gas- and liquid-tight engagement with the end of the barrel.

A piston member 24 is slidable within the barrel and comprises a piston head 25 surrounded by an O-ring seal 26 so as to be in gas- and fluid-fight engagement with the inner surface of the barrel 20. Integrally formed with the piston head 25 is a piston rod 27 of smaller diameter which is slidable through a cylindrical portion 28 of the end cap 21, an O-ring seal 29 being provided between the cylindrical portion 28 and the piston rod 27.

An inlet passage 30 extends longitudinally through the piston member 24 and is connected to a flexible inlet conduit 31 through an inlet non-return valve 32 in the form of a spring-loaded ball. The inlet conduit 31 leads from a supply of the liquid to be dispensed.

Figure 2:
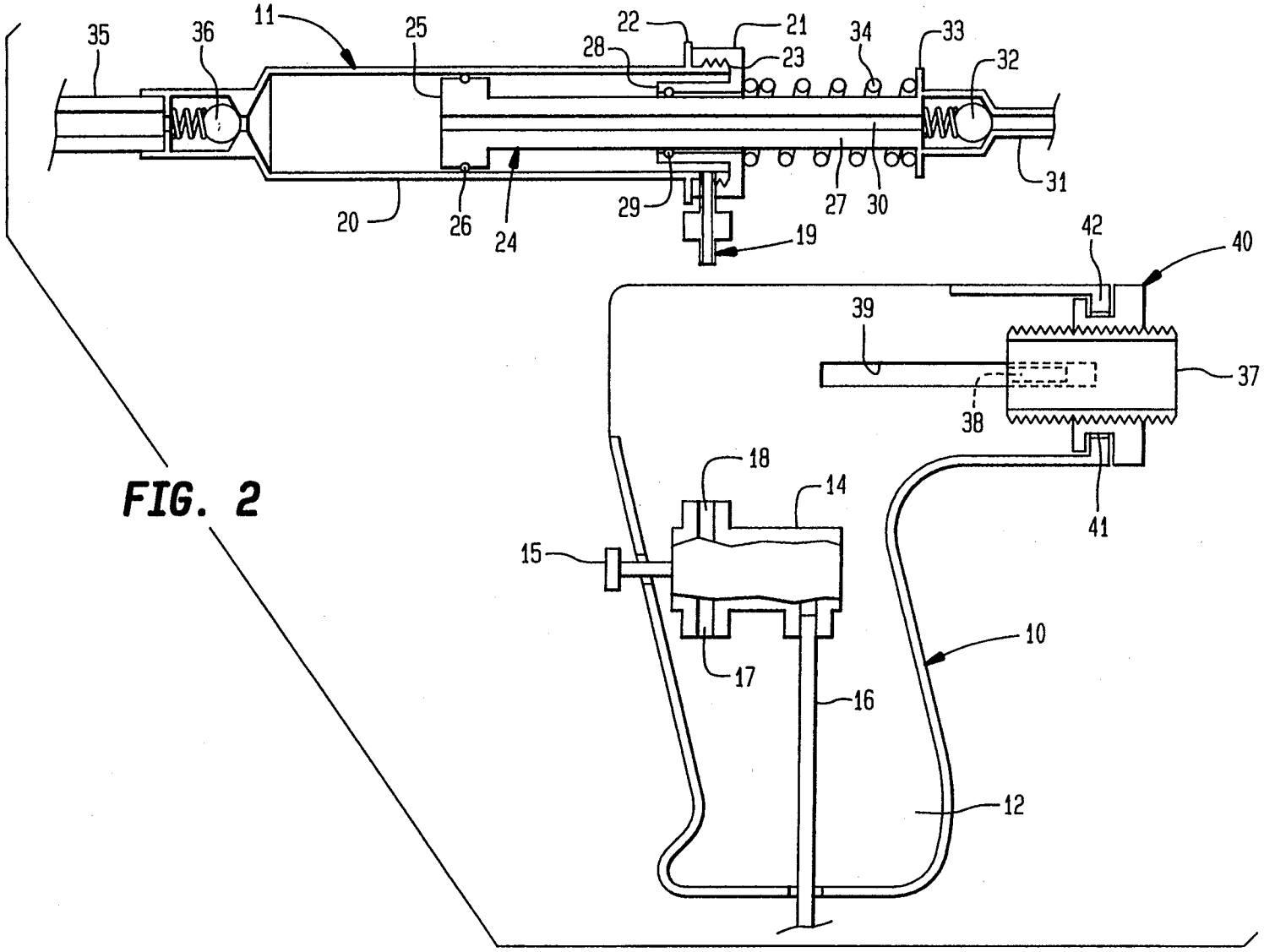
FIG. 2 is a diagrammatic sectional view of the applicator, the dispensing unit being shown separated from the handle for clarity.

An annular abutment flange 33 is formed on the end of the piston rod 27 and a helical compression spring 34 encircles the piston rod 27 between the abutment ring 33 and the end cap 21, so as to bias the piston member 24 to the right as seen in FIG. 2.

The end of the barrel 20 remote from the end cap 21 comprises an outlet passage 35 controlled by an outlet non-return valve 36 in the form of a spring-loaded ball.

Although the non-return valve 32 is shown as being located at the junction between the piston rod 27 and inlet conduit 31, in an alternative and preferred arrangement it is mounted within the piston 24 itself, adjacent the piston head 25.

The applicator operates as follows:

Initially, the piston member 24 is in a retracted position shown in FIG. 2, being maintained in that position by the spring 34, and the left-hand end of the barrel 20 is filled with air. The right-hand end of the barrel behind the piston head 25 is in communication with atmosphere through the connector 19, valve 14 and exhaust port 17.

Upon depression of the actuating button 15, the connector 19 is placed in communication with the gas bottle and the right-hand end of the barrel 20 behind the piston head 25 is pressurized. The piston member 24 thus moves to the left-hand end of the barrel 20, air being expelled from the barrel through the non-return valve 36.

Upon release of the actuating button 15, the portion of the barrel 20 behind the piston head 25 is once more placed into communication with exhaust and the piston member 24 is thus moved to the right under the action of the helical compression spring 34. The non-return valve 36 closes and a low pressure is created in the left-hand of the barrel 20. Consequently, the non-return valve 32 opens and liquid is drawn into the barrel 20 through the inlet conduit 31 and passage 30 in the piston member 24.

When the actuating button 15 is again operated, and the right-hand end of the barrel 20 is pressurized to force the piston member 24 to the left, the dose of liquid previously drawn into the barrel 20 is discharged through the non-return valve 36 and outlet passage 35. Upon subsequent release of the button 15, the piston member 24 is again moved to the right under the action of the compression spring 34, drawing a further dose of liquid into the barrel 20. The operation may be repeated as many times as desired.

It will be apparent that the quantity of liquid drawn into the barrel 20 during each operation of the dispensing unit depends on the volume within the barrel 20 to the left of the piston head 25, when the piston is retracted. This volume, in turn is determined by the distance moved by the piston member 24 as it is withdrawn from the barrel 20 by the spring 34. Accordingly, in order to provide adjustment of the dose dispensed by the applicator, an adjustable abutment is provided on the handle 10 to vary the extent to which the piston member 24 is withdrawn from the barrel 20.

Referring to the FIG. 2, the adjustable abutment member comprises an externally threaded tubular member 37 through which the inlet conduit 31 passes as it leaves the handle 10. The tubular member 37 is provided with external lugs, one of which is indicated at 38, which are slidable within slots 39, formed in the handle 10. The engagement between the lugs 38 and the slots 39 both guides the sliding movement of the tubular member 37 and also prevents it from rotating relatively to the handle 10. A knurled control collar 40 is arranged in threaded engagement with the tubular member 37 and is rotatable on the hollow part 12 of the handle. The collar 40 is provided with a peripheral groove 41 within which engages an encircling internal flange 42 on the handle 10.

During each retraction of the piston member 24, the movement of the piston member stops when the flange 33 on the end of the piston rod 27 comes into engagement with the inner end of the tubular member 37. Thus, the amount of retraction of the piston member 24, and hence the amount of liquid dispensed, may be varied by rotating the collar 40 to move the tubular member 37 into or out of the handle.

A gauge preferably is provided to indicate the volume of liquid corresponding to each position of the tubular member 37. Such gauge might comprise a scale mounted on the handle along which moves a pointer connected to the tubular member 37. Preferably, however, the barrel 20 is transparent and a scale is marked on the external surface of the barrel 20 itself. The volume to be dispensed is then indicated by the position of the piston head 25 on the scale, when in its retracted position.

Since the dispensing unit 11 is a complete module which may be detached readily from the handle assembly 10, the same handle may be used with different dispensing units, thus allowing dispensing units of different sized barrels readily to be interchanged.

It should be understood that the foregoing relates to a limited number of preferred embodiments of the invention which have been by way of and that it is intended to cover all changes and modifications of the examples of the invention herein chosen for the purpose of the disclosure, which do not constitute departures from the spirit and scope of the invention.

What is claimed is:

1. A gas powered applicator for dispensing measured doses of a liquid and comprising:

a handle;

a dispensing unit mounted detachably on said handle;

a source of gas under pressure;

an exhaust;

a manually operable gas control valve adapted to place said dispensing unit selectively in communication with said source of gas under pressure or with said exhaust;

said dispensing unit comprising:.

a cylinder;

piston slidable within said cylinder;

connecting means connecting one end of said cylinder on a first side of said piston to said manually operable gas control valve;

spring means biasing said piston toward said one end of said cylinder;

a source of liquid medicament to be dispensed;

an inlet non-return valve;

inlet means through said piston for communicating said source of liquid medicament to the cylinder on a second side of said piston, the flow of medicament through the inlet means being controlled by said inlet non-return valve;

an outlet non-return valve at an other end of said cylinder; and outlet means leading from said other end of said cylinder, the flow of medicament therethrough being controlled by said outlet non-return valve;

said inlet non-return valve disposed in an inlet passage;

said connecting means connecting said one end of the cylinder to said gas control valve and comprising a detachable coupling;

an adjustable abutment means mounted on said handle for limiting the extent of withdrawal of said piston from said cylinder thereby controlling volume of dose of the medicament drawn into said cylinder on the second side of said piston and subsequently dispensed.

2. The gas powered applicator as claimed in claim 1 wherein said spring means comprise a helical spring encircling a portion of said piston outside said cylinder and disposed between said cylinder and said adjustable abutment means on said handle.

3. The gas powered applicator as claimed in claim 1 wherein the abutment means comprise an externally threaded elongate element slidably mounted on said handle and threadedly engaged by an internally threaded operating element rotatably mounted on said handle whereby rotation of said operating element effects longitudinal adjustment of said elongate element.

* * * * *